US009922599B2

(12) United States Patent
Li et al.

(10) Patent No.: US 9,922,599 B2
(45) Date of Patent: Mar. 20, 2018

(54) DEVICES AND METHODS FOR APPLYING DATA VOLTAGE SIGNAL, DISPLAY PANELS AND DISPLAY DEVICES

(71) Applicants: Shanghai Tianma AM-OLED Co., Ltd., Shanghai (CN); Tianma Micro-Electronics Co., Ltd., Shenzhen (CN)

(72) Inventors: Yue Li, Shanghai (CN); Tong Zhang, Shanghai (CN); Dong Qian, Shanghai (CN); Yi Du, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 98 days.

(21) Appl. No.: 14/965,854

(22) Filed: Dec. 10, 2015

(65) Prior Publication Data

US 2017/0011687 A1 Jan. 12, 2017

(30) Foreign Application Priority Data

Jul. 9, 2015 (CN) ..... 2015 1 0401986

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0819* (2013.01); *G09G 2300/0842* (2013.01); *G09G 2300/0861* (2013.01); *G09G 2310/08* (2013.01); *G09G 2320/045* (2013.01)

(58) Field of Classification Search
CPC ... G09G 2300/0819; G09G 2300/0842; G09G 2300/0861; G09G 2310/08; G09G 2320/045; G09G 3/3258; G09G 3/3291
See application file for complete search history.

(56) References Cited

U.S. PATENT DOCUMENTS

2004/0056828 A1 3/2004 Choi et al.
2008/0198102 A1* 8/2008 Yamashita ..... G09G 3/3233 345/76
2008/0198104 A1* 8/2008 Yamashita ..... G09G 3/3233 345/77

(Continued)

FOREIGN PATENT DOCUMENTS

CN 1577453 A 2/2005
CN 1734546 A 2/2006

(Continued)

*Primary Examiner* — Viet Pham
(74) *Attorney, Agent, or Firm* — Faegre Baker Daniels LLP

(57) ABSTRACT

A device and method for applying a data voltage signal, a display panel, and a display device. The device for applying the data voltage signal includes: a voltage signal detection module configured to detect an image signal inputted to a display assembly; and a threshold compensation signal outputting module configured to process the inputted image signal and apply the processed image signal to a gate electrode of a driving transistor so that the driving transistor is turned on before a threshold compensation for the driving transistor is conducted; where, the processed image signal is obtained by subtracting a preset voltage signal from the inputted image signal.

10 Claims, 11 Drawing Sheets

(56) References Cited

U.S. PATENT DOCUMENTS

| | | | | |
|---|---|---|---|---|
| 2008/0231199 | A1* | 9/2008 | Yamamoto | G09G 3/3233 315/169.3 |
| 2009/0079678 | A1 | 3/2009 | Ozawa | |
| 2016/0117981 | A1* | 4/2016 | Lee | G09G 3/3233 345/214 |

FOREIGN PATENT DOCUMENTS

| | | | |
|---|---|---|---|
| CN | 101656046 | A | 2/2010 |
| CN | 103123773 | A | 5/2013 |
| CN | 103236238 | A | 8/2013 |
| JP | 2015505980 | A | 2/2015 |
| WO | 2014174905 | A1 | 10/2014 |

* cited by examiner

DEVICES AND METHODS FOR APPLYING DATA VOLTAGE SIGNAL, DISPLAY PANELS AND DISPLAY DEVICES

CROSS-REFERENCE TO RELATED APPLICATION

This application claims priority to Chinese Application No. 201510401986.8, filed Jul. 9, 2015, which is herein incorporated by reference in its entirety.

TECHNICAL FIELD

The present disclosure relates to the field of display technologies and, in particular, to devices and methods for applying a data voltage signal, display panels, and display devices.

BACKGROUND

An organic light-emitting diode (OLED), as a solid-state device for directly transforming electrical energy into optical energy, has advantages such as a low thickness, a light weight, a high contrast, a quick response, a wide viewpoint, and a wide range of working temperatures, which has drawn lots of attention from manufacturers.

SUMMARY

Embodiments of the disclosure provide a device and method for applying a data voltage signal, a display panel, and a display device, such that an ideal electrical potential at the gate electrode of a driving transistor can be achieved in a short enough time during a subsequent voltage threshold compensation stage, to thereby achieve a high resolution.

In a first example, embodiments of the disclosure provide a device for applying a data voltage signal, including:

a voltage signal detection module configured to detect an image signal inputted to a display assembly; and a threshold compensation signal outputting module configured to process the inputted image signal and apply the processed image signal to a gate electrode of a driving transistor so that the driving transistor is turned on before a threshold compensation for the driving transistor is conducted;

wherein, the processed image signal is obtained by subtracting a preset voltage signal from the inputted image signal.

In a further aspect, an embodiment of the present disclosure further provides an OLED pixel circuit, including the device for applying a data voltage signal described above.

In a further aspect, an embodiment of the present disclosure further provides a display panel, including the OLED pixel circuit described above.

In a further aspect, an embodiment of the present disclosure further provides a display, including the display panel described above.

In a further aspect, an embodiment of the present disclosure further provides a method for applying a data voltage signal, including:

detecting an image signal inputted to a display assembly when a driving transistor of the display assembly is in a turned-off state; and processing the inputted image signal and applying the processed image signal to a gate electrode of the driving transistor so that the driving transistor is turned on before finishing a threshold compensation for the driving transistor; wherein, the processed image signal is obtained by subtracting a preset voltage signal from the inputted image signal.

In embodiments, the difference between the voltage of the inputted image signal and the voltage of the preset voltage signal is applied to the gate electrode of the driving transistor, so that the driving transistor is turned on before finishing the threshold compensation, and the gate voltage at the gate electrode of the driving transistor can reach an ideal level within a short time during the subsequent threshold compensation, to thereby achieve a high resolution.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

Figure 1A:
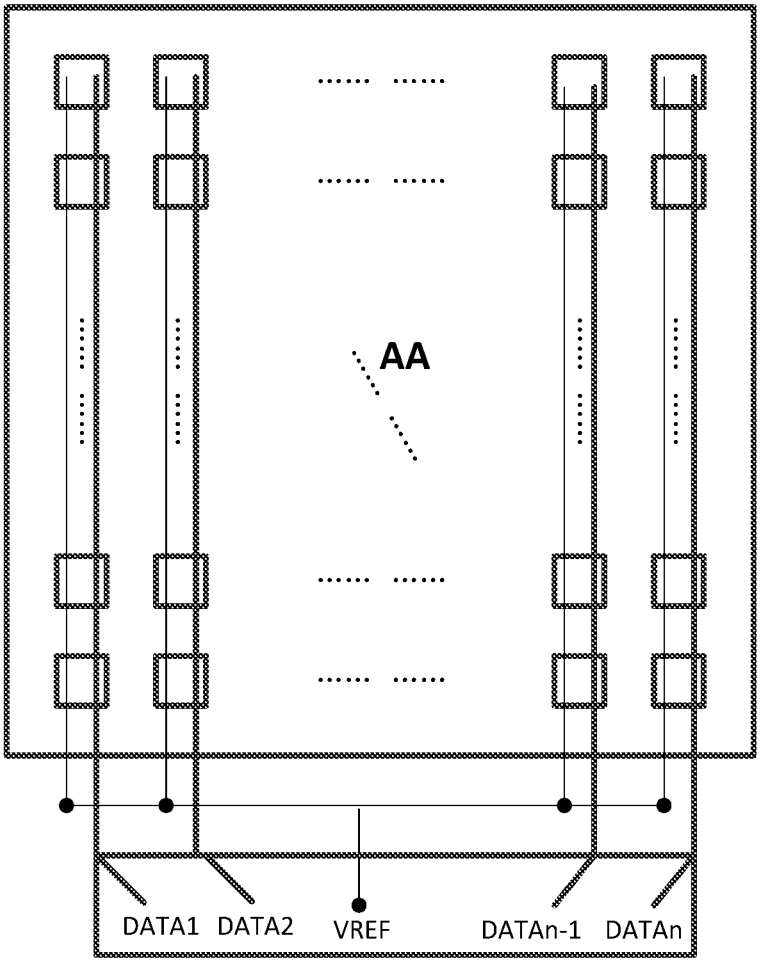
FIG. 1A is a schematic diagram showing the structure of a driving device.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The disclosure will be further illustrated in detail below in conjunction with the accompanying drawings and embodiments. It may be understood that specific embodiments described herein are merely for explaining the disclosure rather than limiting the disclosure. Additionally, it is noted that merely partial contents associated with the disclosure rather than all contents are illustrated in the accompanying drawings for ease of description.

Currently, as shown in FIG. 1A, a flat panel display is driven in a matrix driving manner, i.e. driven by a matrix formed by electrodes in an X direction and electrodes in a Y direction. Each column of pixel circuits are commonly driven by one data line DATA, and all columns of pixel circuits share one reference voltage (VREF) signal line. Herein, the working principle of the pixel circuit is illustrated now based on the pixel circuit shown in FIG. 1B, for example. The pixel circuit shown in FIG. 1B includes six transistors M1, M2, M3, M4, M5, M6 and one capacitor Cst, among which the transistor M3 functions as a driving transistor. The pixel circuit works in three working stages including a first stage, a second stage and a third stage. During the first stage, a first scanning line SCAN1 outputs a low level, and a second scanning line SCAN2 and a driving signal line EMIT both output a high level, thus the transistor M5 is turned on, so that a voltage VREF is outputted from the VREF signal line as a gate voltage N1 of the transistor M3. In order to ensure that the transistor M3 is turned on at the beginning of the second stage, the gate voltage N1, i.e. the voltage VREF, of the transistor M3 needs to be set at a low level in the first stage; during the second stage, i.e. a stage of voltage threshold compensating at the gate electrode of the transistor M3, the first scanning line SCAN1 and the driving signal line EMIT both output a high level, and the second scanning line SCAN2 outputs a low level, so that the transistors M2 and M3 are turned on, at this time, the gate voltage N1 of the transistor M3 is equal to VDATA−VTH and stored within the capacitor Cst, where VDATA represents a data voltage, and VTH represents a critical voltage of the transistor M3; and during the third stage, i.e. a stage of driving the OLEDs to emit light, the first scanning line SCAN1 and the second scanning line SCAN2 both output a high level, and the driving signal line EMIT outputs a low level, so that the transistors M1, M3 and M6 are turned on, and a current flows to the OLED light emitting assembly to drive the OLED light emitting assembly to emit light. In order to ensure that the transistor M3 is turned on at the beginning of the second stage, the VREF signal line connected with the gate electrode of the transistor M3 needs to output a low level in the first stage. For example, if the data voltage VDATA varies in a range from 0V to 5V, the voltage VREF is required to be less than 0V (i.e. a lower limit of the data voltage VDATA) by a voltage threshold (i.e. the critical voltage of the transistor M3, such as −2V), in order to meet a condition of turning on the transistor M3, thereby ensuring that the transistor M3 works properly when the data voltage VDATA is in a range from 0V to 5V.

However, the above driving manner is defective in that: in the voltage threshold compensation at the gate electrode of the transistor M3 in the second stage, if the data voltage VDATA=5V is inputted and the initial electrical potential of the gate electrode of the transistor M3 is −2V, the voltage at the gate electrode of the transistor M3 needs to be raised from −2V to VDATA−VTH=5V−2V=3V, which leads to a large voltage span, the time for reaching the expected or ideal electrical potential of the gate electrode of the transistor M3 is prolonged or the electrical potential of the gate electrode of the transistor M3 cannot be raised to the expected or ideal level in time by charging, thus obstructing a high resolution of the display panel.

Figure 2A:
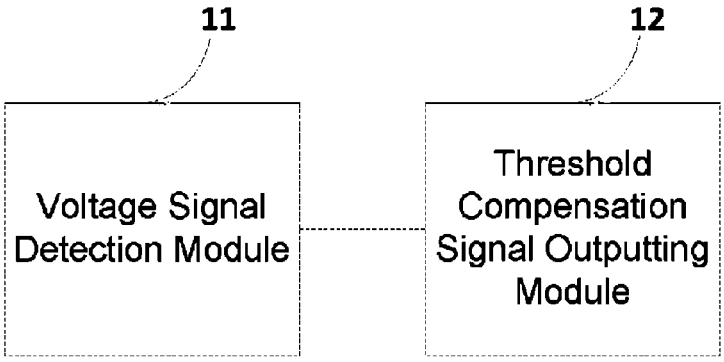
FIG. 2A is a schematic diagram showing the structure of a device for applying a data voltage signal, according to embodiments of the disclosure.

FIG. 2A is a schematic diagram showing the structure of a device for applying a data voltage signal, according to embodiments of the disclosure. As shown in FIG. 2A, the device includes a voltage signal detection module 11 and a threshold compensation signal outputting module 12.

The voltage signal detection module 11 is configured to detect an image signal inputted to a display assembly.

The threshold compensation signal outputting module 12 is configured to process the inputted image signal and apply the processed image signal to a gate electrode of a driving transistor so that the driving transistor is turned on before finishing the threshold compensation for the driving transistor is conducted.

The processed image signal is obtained by subtracting a preset voltage signal from the inputted image signal. That is, the size of the processed image signal is a difference between the voltage of the inputted image signal and the voltage of the preset voltage signal. The preset voltage signal can be preset according to the inputted image signal and a critical voltage of the gate electrode of the driving transistor. For example, if the voltage of the inputted image signal is 5V and the critical voltage of the gate electrode of the driving transistor is 0.2V, the voltage of the preset voltage signal can be set as any value larger than or equal to 0.2V and smaller than or equal to 4.8V (in order to ensure that the preset voltage signal enables the driving transistor to be turned on before the threshold compensation of the driving transistor). In order to ensure that the voltage at the gate electrode of the driving transistor quickly reaches an expected or ideal electrical potential in the threshold compensation of the driving transistor, the preset voltage signal is set as small as possible, and in some embodiments, is set as the critical voltage of the gate electrode of the driving transistor such as 0.2V or slightly larger than 0.2V.

Figure 2B:
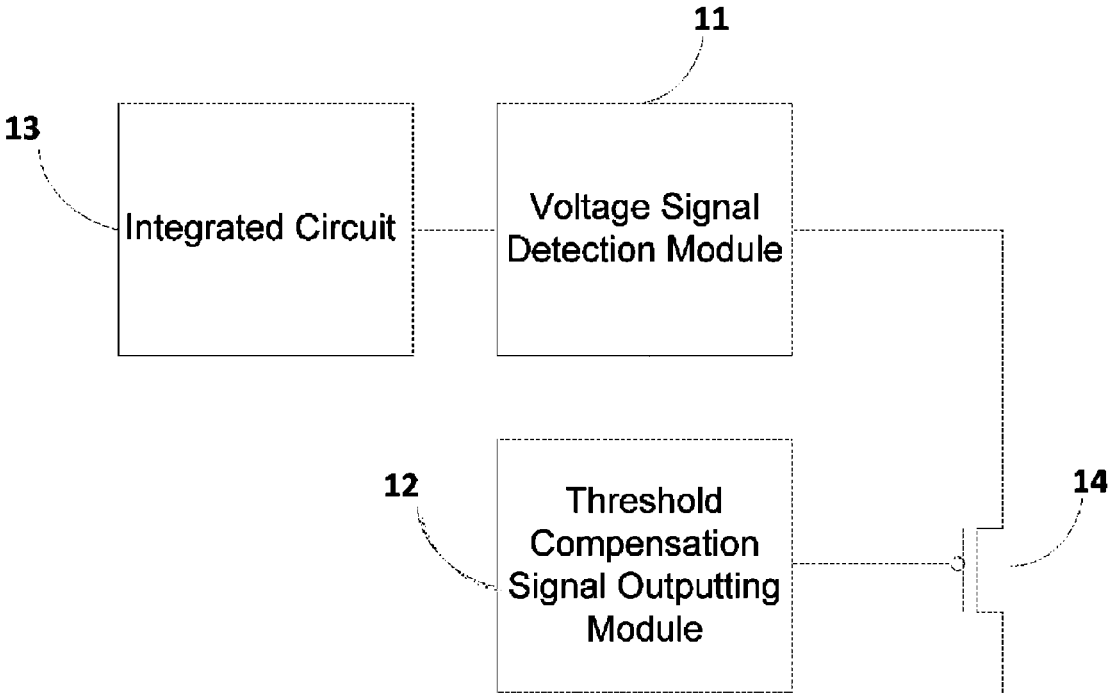
FIG. 2B is a schematic diagram showing a structure including the device for applying the data voltage signal, according to embodiments of the disclosure.

The inputted image signal is a voltage signal obtained by processing an original image to be displayed. In particular, as shown in FIG. 2B, the voltage signal detection module 11 includes one input terminal and two output terminals. The input terminal of the voltage signal detection module 11 is connected with an output terminal of an integrated circuit 13 to receive an image signal outputted from the integrated circuit 13. One of the output terminals of the voltage signal detection module 11 is connected with an input terminal of the threshold compensation signal outputting module 12 to apply the inputted image signal to the threshold compensation signal outputting module 12, and the other of the output terminals of the voltage signal detection module 11 is connected to a source electrode of a driving transistor 14 to apply the inputted image signal to the source electrode of the driving transistor 14 during the threshold compensating stage. An output terminal of the threshold compensation signal outputting module 12 is connected with a gate electrode of the drive transistor 14 to apply the processed image signal to the gate electrode of the driving transistor 14 before the threshold compensation.

Figure 2C:
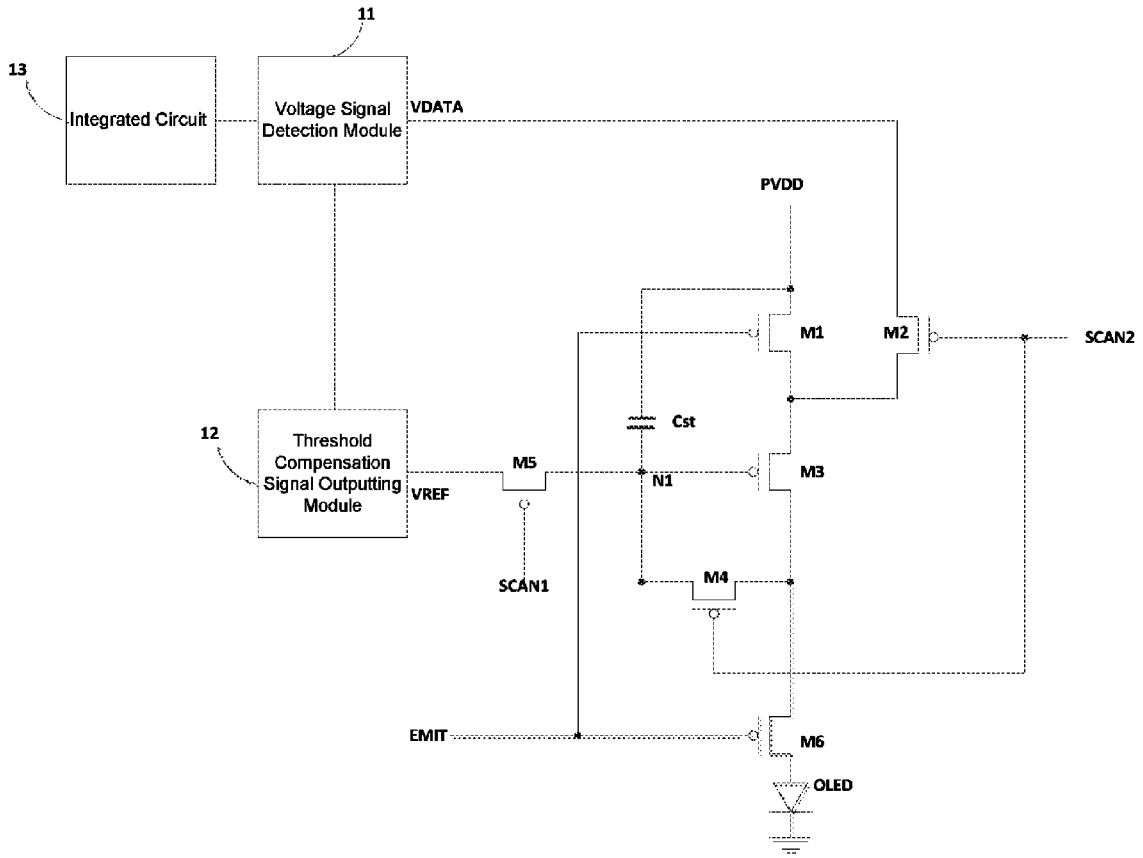
FIG. 2C is a schematic diagram showing a structure of driving circuits with the device for applying the data voltage signal, according to embodiments of the disclosure.

Working principles of embodiments of the disclosure are illustrated in detail in combination with the driving circuit shown in FIG. 2C. As shown in FIG. 2C, the other of the output terminals of the voltage signal detection module 11 is connected with a source electrode of a driving transistor M2, and the output terminal of the threshold compensation signal outputting module 12 is connected with a gate electrode of a driving transistor M3 via a driving transistor M5.

Figure 2D:
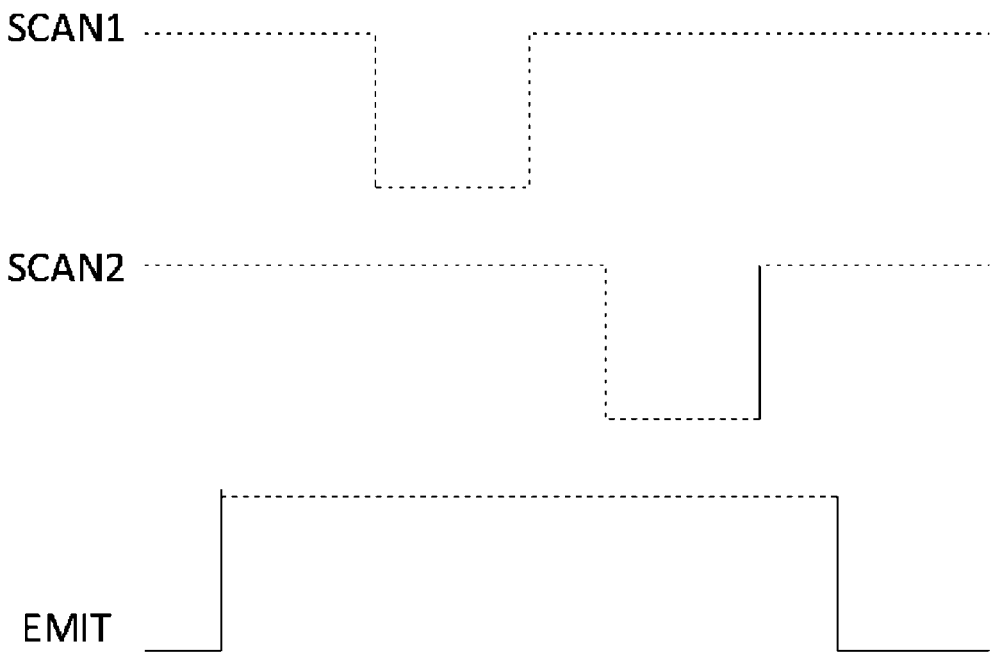
FIG. 2D is a schematic diagram showing signal waveforms inputted in relation to the device for applying the data voltage signal, according to embodiments of the disclosure.

A voltage driving signal from a first scanning line SCAN1, a voltage driving signal from a second scanning line SCAN2, and a voltage driving signal from a driving signal line EMIT are shown in FIG. 2D. The device works in the following three working stages including a first stage, a second stage and a third stage.

During the first stage preceding the threshold compensation, the first scanning line SCAN1 is at a low level, and the second scanning line SCAN2 and the driving signal line EMIT both are at a high level, so that the transistor M5 is turned on, a voltage VREF provided by the output terminal of the threshold compensation signal outputting module 12, i.e. a difference between the inputted image signal from the voltage signal detection module 11 and a preset voltage signal, is applied to the gate electrode of the transistor M3 as a gate voltage N1 of the transistor M3, thus the transistor M3 is turned on. At this time, the gate voltage N1 of the transistor M3 is equal to VDATA subtracted by a voltage of the preset voltage signal and stored in a capacitor Cst, where VDATA represents a voltage of the inputted image signal.

During the second stage (i.e. a threshold compensating stage), the first scanning line SCAN1 and the driving signal line EMIT both are at a high level, and the second scanning line SCAN2 is at a low level, so that the transistor M2 is turned on and the voltage VDATA of the inputted image signal is applied to the source electrode of the transistor M3; further, since the transistor M3 is still turned on, the gate voltage N1 of the transistor M3 is raised to the voltage VDATA of the inputted image signal. Since the gate voltage N1 of the transistor M3 is equal to the voltage VDATA subtracted by the voltage of the preset voltage signal, the storage capacitor Cst needs to be charged so that the gate voltage N1 of the transistor M3 is gradually increased from the voltage VDATA subtracted by the voltage of the preset voltage signal to the voltage VDATA, as such, the voltage of the capacitor needs to be raised by merely the voltage of the preset voltage signal by charging.

During the third stage (i.e. an OLED light emitting stage), the first scanning line SCAN1 and the second scanning line SCAN2 both are at a high level, and the driving signal line EMIT is at a low level, so that the transistors M1, M3 and M6 are turned on, and a current flows to the OLED light emitting assembly to drive the OLED light emitting assembly to emit light. Therefore, with the solution of embodiments of the disclosure, the gate voltage at the gate electrode of the driving transistor can reach an expected or ideal level within a short time during the threshold compensation, thereby achieving a high resolution.

In embodiments, the difference between the voltage of the inputted image signal and the voltage of the preset voltage signal is applied to the gate electrode of the driving transistor, so that the driving transistor is turned on before finishing the threshold compensation, and the gate voltage at the gate electrode of the driving transistor can reach an ideal level within a short time during the subsequent threshold compensation, thereby achieving a high resolution.

On the basis of embodiments described above, the image signal is read from a control module by columns or rows of pixel circuits before detecting the image signal.

Figure 2E:
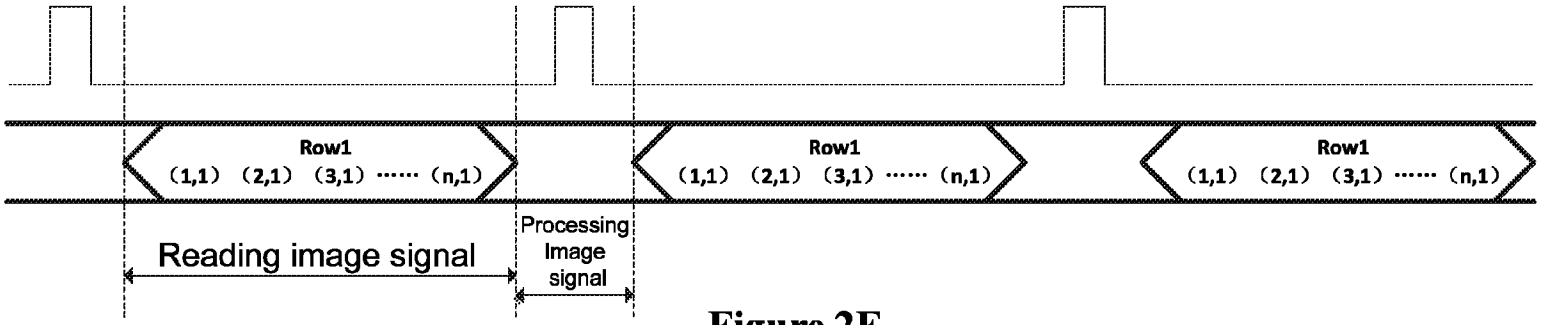
FIG. 2E is a schematic diagram of reading image signals by columns in relation to the device for applying the data voltage signal, according to embodiments of the disclosure.
Figure 2F:
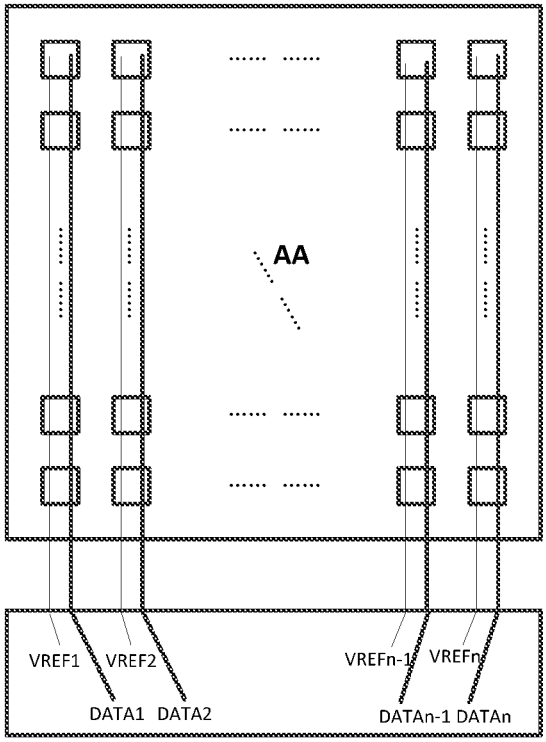
FIG. 2F is a schematic diagram showing a first pixel circuit layout in relation to the device for applying the data voltage signal, according to embodiments of the disclosure.

The control module may be an integrated circuit IC. In particular, FIG. 2E is a schematic diagram illustrating that the voltage signal detection module reads the image signals from the integrated circuit by columns, and correspondingly, FIG. 2F is a schematic diagram illustrating that the threshold compensation signal outputting module applies the processed imaged signals, i.e. reference voltages VREF1, VREF2, . . . , VREFn−1, and VREFn, to the gate electrodes of the driving transistors by columns. The voltage signal detection module reads the image signal from the integrated circuit by columns, for example, reads image signals for a plurality of columns one time, and in one aspect, inputs the image signals to the source electrodes of the driving transistors by columns, and in another aspect, inputs the image signals by columns to the threshold compensation signal outputting module for processing, i.e. subtracting the image signals by the preset voltage signal to obtain the processed imaged signals. Also, the threshold compensation signal outputting module applies the processed imaged signals, i.e. the reference voltages, to the gate electrodes of the driving transistors by columns.

Figure 2G:
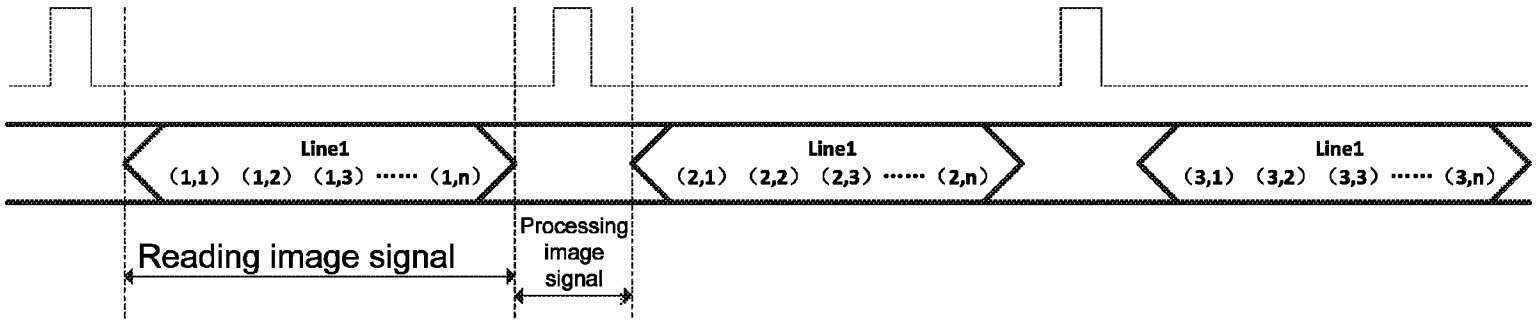
FIG. 2G is a schematic diagram of reading image signals by rows in relation to the device for applying the data voltage signal, according to embodiments of the disclosure.
Figure 2H:
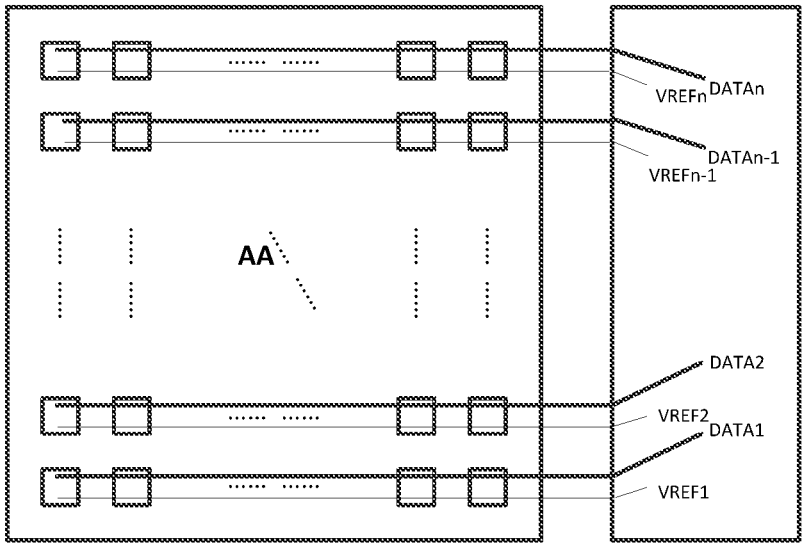
FIG. 2H is a schematic diagram showing a second pixel circuit layout in relation to the device for applying the data voltage signal, according to embodiments of the disclosure.

FIG. 2G is a schematic diagram illustrating that the voltage signal detection module reads the image signals from the integrated circuit by rows, and correspondingly, FIG. 2H is a schematic diagram illustrating that the threshold compensation signal outputting module applies the processed imaged signals, i.e. reference voltages VREF1, VREF2, . . . , VREFn−1, and VREFn, to the gate electrodes of the driving transistors by rows. The voltage signal detection module reads the image signal from the integrated circuit by rows, for example, reads image signals for a plurality of rows one time, and in one aspect, inputs the image signals to the source electrodes of the driving transistors by rows, and in another aspect, inputs the image signals by rows to the threshold compensation signal outputting module for processing, i.e. subtracting the image signals by the preset voltage signal to obtain the processed imaged signals. Also, the threshold compensation signal outputting module applies the processed imaged signals, i.e. the reference voltages, to the gate electrodes of the driving transistors by rows.

For example, the inputted original image signal to be processed can be processed to obtain the processed image signal in the form of a Piecewise Linear (PWL) voltage signal.

In the various embodiments described above, the difference between the voltage of the inputted image signal and the voltage of the preset voltage signal is applied to the gate electrode of the driving transistor, such as driving transistor M3, so that the driving transistor is turned on before the threshold compensation of the driving transistor, thus the gate voltage at the gate electrode of the driving transistor can reach an ideal level within a short time during the subsequent threshold compensation, thereby achieving a high resolution.

Figure 3:
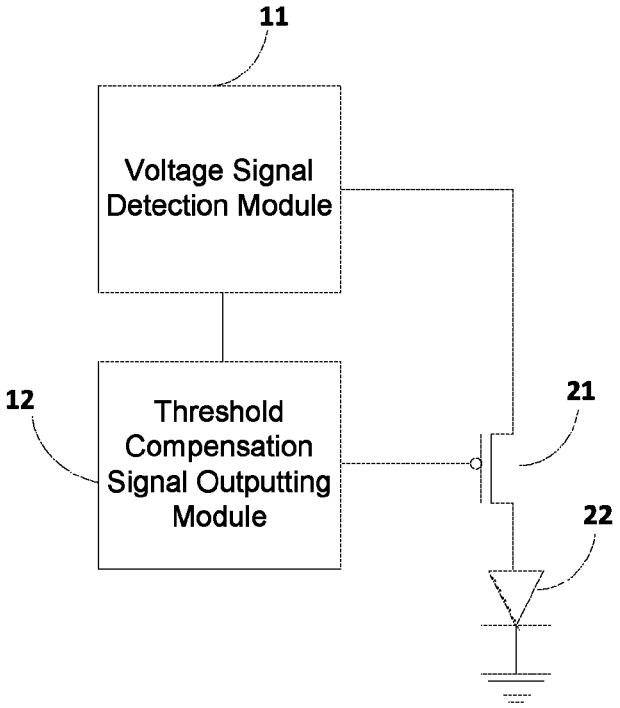
FIG. 3 is a schematic diagram showing the structure of an OLED pixel circuit, according to embodiments of the disclosure.

FIG. 3 is a schematic diagram showing the structure of an OLED pixel circuit, according to embodiments of the disclosure. As shown in FIG. 3, the OLED pixel circuit includes a driving transistor 21 in addition to the voltage signal detection module 11 and the threshold compensation signal outputting module 12.

A gate electrode of the driving transistor 21 is connected to a reference voltage signal line (which is also connected with the output terminal of the threshold compensation signal outputting module 12), via which the reference voltage signal, i.e. the processed image signal, is inputted to the gate electrode of the driving transistor 21.

A source electrode of the driving transistor 21 is connected with an image signal line to receive the inputted image signal from the voltage signal detection module 11.

Figure 1B:
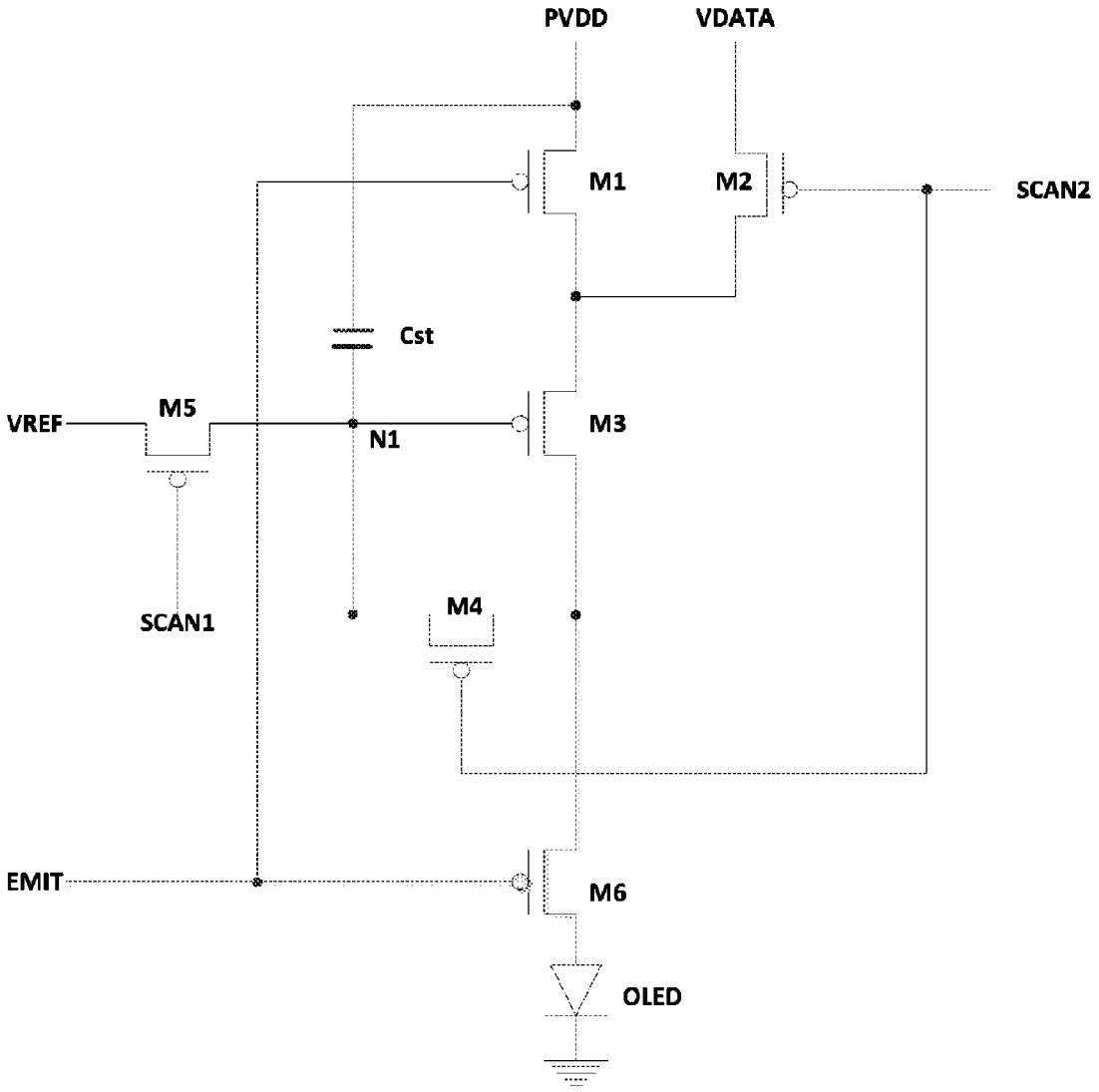
FIG. 1B is a schematic diagram showing the structure of a driving circuit in the driving device.

In particular, there may be a plurality of the driving transistors, for example, as shown in the driving circuit in FIG. 1B. The reference voltage signal is provided by the threshold compensation signal outputting module 12, and the image signal is provided by the voltage signal detection module 11.

The working principle of the OLED pixel circuit is similar to that of the device of applying the data voltage signal, and for more details, reference may be made to the description related to the embodiments above, which are not repeated here.

In embodiments, the difference between the voltage of the inputted image signal and the voltage of the preset voltage signal is applied to the gate electrode of the driving transistor 21, so that the driving transistor 21 is turned on before the threshold compensation of the driving transistor 21, thus the gate voltage at the gate electrode of the driving transistor 21 can reach an ideal level within a short time during the subsequent threshold compensation, thereby achieving a high resolution.

For example, on the basis of the embodiments described above, the OLED pixel circuit further includes a light emitting assembly 22.

The light emitting assembly 22 is configured to emit light according to the image signal received from the driving transistor 21.

As shown in FIG. 3, the light emitting assembly 22 is connected to a drain electrode of the driving transistor 21.

Figure 4:
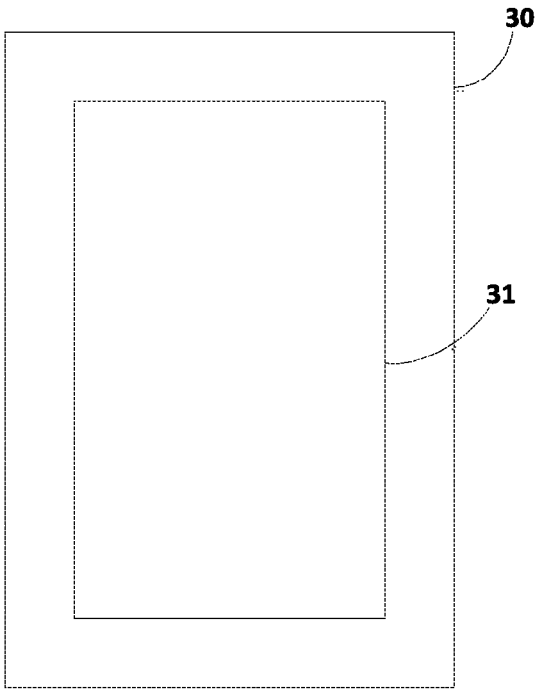
FIG. 4 is a schematic diagram showing the structure of a display panel, according to embodiments of the disclosure.

FIG. 4 is a schematic diagram showing the structure of a display panel according to embodiments of the disclosure. As shown in FIG. 4, the display panel 30 includes the OLED pixel circuit 31 described in the embodiments of FIG. 3.

For example, each column or row of the OLED pixel circuits 31 share one of the reference voltage signal lines respectively providing the reference voltages VREF1, VREF2, . . . , VREFn−1, and VREFn, as shown in FIG. 2F or FIG. 2H.

As such, in embodiments, the difference between the voltage of the inputted image signal and the voltage of the preset voltage signal is applied to the gate electrode of the driving transistor, so that the driving transistor is turned on before the threshold compensation of the driving transistor, thus the gate voltage at the gate electrode of the driving transistor can reach an ideal level within a short time during the subsequent threshold compensation, thereby achieving a high resolution.

Figure 5:
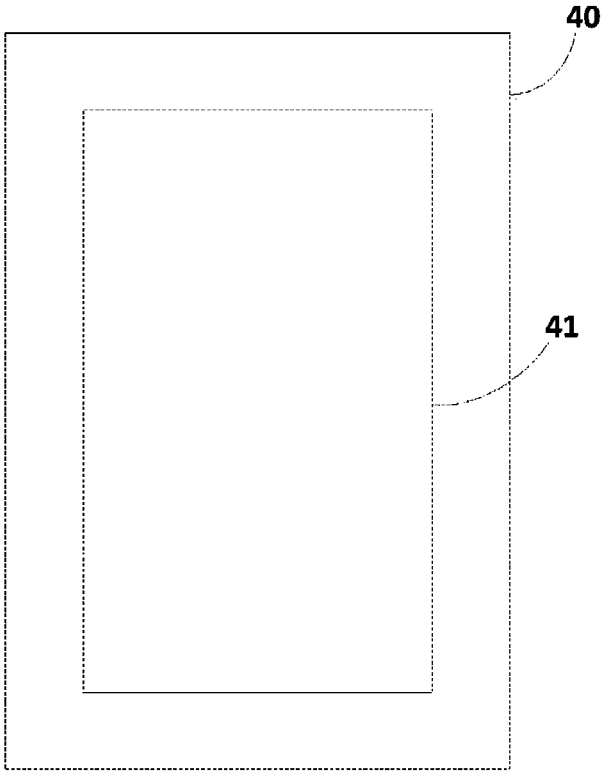
FIG. 5 is a schematic diagram showing the structure of a display, according to embodiments of the disclosure.

FIG. 5 is a schematic diagram showing the structure of a display, according to embodiments of the disclosure. As shown in FIG. 5, the display 40 includes the display panel 41 described in the embodiments of FIG. 4.

In embodiments, the difference between the voltage of the inputted image signal and the voltage of the preset voltage signal is applied to the gate electrode of the driving transistor, so that the driving transistor is turned on before the threshold compensation of the driving transistor, thus the gate voltage at the gate electrode of the driving transistor can reach an ideal level within a short time during the subsequent threshold compensation, thereby achieving a high resolution.

Figure 6:
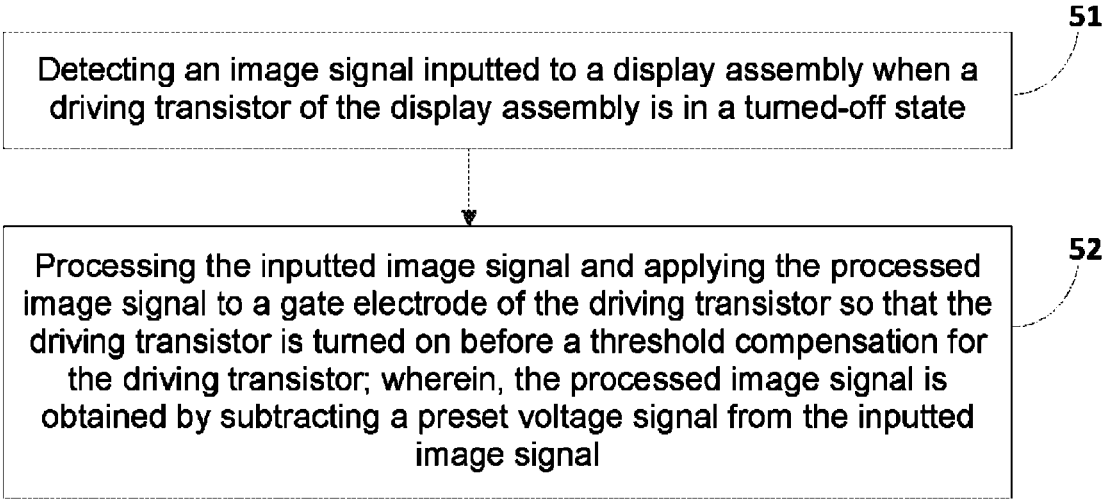
FIG. 6 is a schematic flowchart of a method of applying the data voltage signal, according to embodiments of the disclosure.

FIG. 6 is a schematic flowchart of a method of applying the data voltage signal, according to embodiments of the disclosure. As shown in FIG. 6, the method includes:

step 51 of detecting an image signal inputted to a display assembly when a driving transistor of the display assembly is in a turned-off state; and step 52 of processing the inputted image signal and applying the processed image signal to a gate electrode of the driving transistor, so that the driving transistor is turned on before the threshold compensation for the driving transistor; where the processed image signal is obtained by subtracting a preset voltage signal from the inputted image signal.

In embodiments, the difference between the voltage of the inputted image signal and the voltage of the preset voltage signal is applied to the gate electrode of the driving transistor, so that the driving transistor is turned on before the threshold compensation of the driving transistor, thus the gate voltage at the gate electrode of the driving transistor can reach an ideal level within a short time during the subsequent threshold compensation, thereby achieving a high resolution.

For example, on the basis of the embodiments described above, the voltage of the preset voltage signal is equal to a critical voltage of the driving transistor.

For example, if the image signal has a voltage of 5V and the gate electrode of the driving transistor has a critical voltage of 0.2V, the voltage of the preset voltage signal may be set as the critical voltage of 0.2V, so that a voltage of 4.8V is applied to the gate electrode of the driving transistor before the threshold compensation. Thus, ideally, the voltage of the gate electrode of the driving transistor is also 4.8V when the threshold compensation begins, and the gate voltage at the gate electrode of the driving transistor can reach an ideal level shortly at the beginning of the threshold compensating stage, thereby achieving a high resolution.

For example, on the basis of the embodiments described above, the method further includes: reading the data voltage signal from the control module by columns or rows of pixel circuits before detecting the data voltage signal.

In particular, as shown in FIG. 2E, the image signals are read from an integrated circuit by columns, and correspondingly, as shown in FIG. 2F, the processed imaged signals, i.e. the reference voltages VREF1, VREF2, . . . , VREFn−1, and VREFn, are applied to the gate electrodes of the driving transistors by columns. The voltage signal detection module reads the image signal from the integrated circuit by columns, for example, reads image signals for a plurality of columns one time, and in one aspect, inputs the image signals to the source electrodes of the driving transistors by columns, and in another aspect, inputs the image signals by columns to the threshold compensation signal outputting module for processing, i.e. subtracting the image signals by the preset voltage signal to obtain the processed imaged signals. Also, the threshold compensation signal outputting module applies the processed imaged signals, i.e. the reference voltages, to the gate electrodes of the driving transistors by columns.

Likewise, as shown in FIG. 2G, the image signals are read from the integrated circuit by rows, and correspondingly, as shown in FIG. 2H, the processed imaged signals, i.e. the reference voltages VREF1, VREF2, . . . , VREFn−1, are applied to the gate electrodes of the driving transistors by rows. The voltage signal detection module reads the image signal from the integrated circuit by rows, for example, reads image signals for a plurality of rows one time, and in one aspect, inputs the image signals to the source electrodes of the driving transistors by rows, and in another aspect, inputs the image signals by rows to the threshold compensation signal outputting module for processing, i.e. subtracting the image signals by the preset voltage signal to obtain the processed imaged signals. Also, the threshold compensation signal outputting module applies the processed imaged signals, i.e. the reference voltages, to the gate electrodes of the driving transistors by rows.

For example, on the basis of the embodiments described above, the image signal is a PWL signal.

It should be noted that the above description describes embodiments and technical principles of the disclosure. Those skilled in this art and others will understand that the disclosure is not limited to the specific embodiments described herein, and various apparent changes, rearrangements and substitutions may be made without departing from the protecting scope of the disclosure. Therefore, although the disclosure has been described in detail as above in connection with the embodiments, the disclosure is not limited thereto and may include other embodiments without departing from the conception of the disclosure Various modifications and additions can be made to the exemplary embodiments discussed without departing from the scope of the disclosure. For example, while the embodiments described above refer to particular features, the scope of the disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

We claim:

1. An OLED pixel circuit, comprising:

a voltage signal detection module, a threshold compensation signal outputting module, and a driving transistor, wherein the driving transistor includes an input terminal and a control terminal, in a pre-threshold compensation phase, the voltage signal detection module is configured to be electrically connected to the threshold compensation signal outputting module, and transmit an image signal to the threshold compensation signal outputting module, the threshold compensation signal outputting module configured to process the image signal based on a preset voltage signal to obtain a processed image signal and transmit the processed image signal to the control terminal of the driving transistor to turn on the driving transistor, wherein a voltage of the processed image signal is equal to a difference between a voltage of the image signal and a voltage of the preset voltage signal, and in a threshold compensation phase, the voltage signal detection module is configured to transmit the image signal to the driving transistor through the input terminal of the driving transistor.

2. The pixel circuit of claim 1, wherein, the OLED pixel circuit further comprises a light emitting assembly; the light emitting assembly is configured to emit light when receiving an image signal outputted from the driving transistor.

3. The pixel circuit of claim 1, wherein a voltage of the preset voltage signal is equal to a critical voltage of the control terminal of the driving transistor.

4. The pixel circuit of claim 1, wherein the voltage signal detection module is further configured to read the image signals from a control module by columns or rows before transmitting the image signals to the threshold compensation signal outputting module.

5. A display, comprising: an OLED pixel circuit comprising a voltage signal detection module, a threshold compensation signal outputting module, and a driving transistor, wherein the driving transistor comprises an input terminal and a control terminal, in a pre-threshold compensation phase, the voltage signal detection module is configured to be electrically connected to the threshold compensation signal outputting module, and transmit an image signal to the threshold compensation signal outputting module, the threshold compensation signal outputting module configured to process the image signal based on a preset voltage signal to obtain a processed image signal and transmit the processed image signal to the control terminal of the driving transistor to turn on the driving transistor, wherein a voltage of the processed image signal is equal to a difference between a voltage of the image signal and a voltage of the preset voltage signal, and in a threshold compensation phase, the voltage signal detection module is configured to transmit the image signal to the driving transistor through the input terminal of the driving transistor.

6. The display of claim 5, wherein each column or each row of the OLED pixel circuits share one of the reference voltage signal lines.

7. The display of claim 5, the display further comprising a plurality of date lines and a plurality of reference voltage signal lines, the date lines and the reference voltage signal lines are parallel to each other.

8. A method for driving an OLED pixel circuit, comprising:

in a pre-threshold compensation phase, processing an image signal based on a preset voltage signal to obtain a processed image signal and transmitting the processed image signal to a control terminal of a driving transistor to turn on the driving transistor, wherein a voltage of the processed image signal is equal to a difference between a voltage of the image signal and a voltage of the preset voltage signal, and in a threshold compensation phase, transmitting the image signal to the driving transistor through an input terminal of the driving transistor.

9. The method of claim 8, wherein, the voltage of the preset voltage signal is equal to a critical voltage of the gate electrode of the driving transistor.

10. The method of claim 8, further comprising: reading the image signals from a control module by columns or rows before transmitting the image signals to the threshold compensation signal outputting module.

* * * * *